United States Patent [19]

Sakaguchi et al.

[11] Patent Number: 4,674,556

[45] Date of Patent: Jun. 23, 1987

[54] METHOD AND DEVICE FOR CONTROLLING THIN METALLIC STRIP CONTINUOUS CASTING APPARATUS

[75] Inventors: Haruo Sakaguchi; Teruyoshi Suehiro; Kunio Nagai, all of Osaka; Toshie Hashimoto, Izumi; Hisaki Nishiyama, Toyonaka; Masakazu Mohri, Takatsuki, all of Japan

[73] Assignee: Hitachi Zosen Corporation, Osaka, Japan

[21] Appl. No.: 851,478

[22] Filed: Apr. 14, 1986

[30] Foreign Application Priority Data

Jul. 6, 1985 [JP] Japan ..... 60-149056

[51] Int. Cl.[4] ..... B22D 11/06; B22D 11/20; B22D 11/22

[52] U.S. Cl. ..... 164/454; 164/455; 164/150; 164/414; 164/480

[58] Field of Search ..... 164/455, 150, 414, 458, 164/480, 479, 428, 429, 413, 454

[56] References Cited

U.S. PATENT DOCUMENTS 3,731,536 5/1973 Baumann et al. ..... 164/150 X

FOREIGN PATENT DOCUMENTS 58-23545 2/1983 Japan ..... 164/455
58-23546 2/1983 Japan ..... 164/455
935206 6/1982 U.S.S.R. ..... 164/455

*Primary Examiner*—Kuang Y. Lin
*Attorney, Agent, or Firm*—Joseph W. Farley

[57] ABSTRACT

An apparatus for continuously casting a thin metallic strip comprising a melt receiver 3 for receiving molten metal, a pair of rolls 4 rotatably arranged under the melt receiver 3 and opposed to each other with a predetermined clearance, rotary drive device 5 for rotating the rolls 4 to draw out the molten metal under solidification as a casting through said clearance, and supply system 11 for supplying cooling water into the interior of the rolls 4, the apparatus further comprising roll temperature sensors 9 embedded in the outer peripheral portion of each roll 4 and equiangularly spaced circumferentially thereof for detecting the surface temperature of the roll 4, a position detecting device 14 for detecting the rotational position of the roll 4, and a control unit 20 for controlling the rotary drive device 5 and the cooling water supplying system 11 in response to detection signals from the temperature sensors 9 and the position detecting device 14.

6 Claims, 13 Drawing Figures

METHOD AND DEVICE FOR CONTROLLING THIN METALLIC STRIP CONTINUOUS CASTING APPARATUS

FIELD OF THE INVENTION

The present invention relates to a method and device for controlling a thin metallic strip continuous casting apparatus, and more particularly to a method and device for controlling a twin roll type mold.

BACKGROUND OF THE INVENTION

Of the various apparatuses for continously casting a thin metallic strip, there is known one incorporating a twin roll type mold. As shown in FIG. 9, a type twin roll type mold comprises a pair of rolls 41 adapted to be driven at a constant speed by unillustrated rotary drive means, and a melt receiver 43 provided above the rolls 41 and consisting of four rectangularly arranged lateral walls 42 (only three of which are shown). Molten metal A supplied into the melt receiver 43 solidifies and is drawn out as a casting B by the rototing rolls 41 to produce a thin metallic strip.

In the casting apparatus of the above construction, however, the withdrawal at a constant speed of the casting B leads to the following problem.

The molten metal A solidifies upon contact with the outer surface of each internally cooled roll 41 to continuously form a casting shell C as shown in FIG. 10. The temperature of the shell C is higher on the molten metal side than on the roll side, so that the shell C is subjected to a deforming force due to different degrees of contraction within the shell. This results in local reduction in contact force between the shell C and the roll 41 and in an extreme case leads to actual deformation of the shell C with resultant formation of gaps a as shown in FIG. 11. Once such a state occurs, subsequent growth of the shell C causes irregularities in the thickness thereof involving projections and depressions as shown in FIG. 12, and the shell projections upon passage through the outlet clearance of the mold come into contact with the projections of another similarly produced shell C on the other roll 41 to sealingly trap the molten metal therebelow. The thus trapped molten metal subsequently solidifies with a volmetric reduction to accelerate unevenness in the thickness of the casting B or otherwise result in the formation of internal voids, consequently deteriorating the quality of the product.

On the other hand, as illustrated in FIG. 13, a restraining shell D also grows on a corresponding lateral wall 42 adjacent each roll 41 during the casting operation to ultimately merge at its thin leading edge with the thin trailing edge of the casting shell C. The restraining shell D tends to restrain the forward movement of the casting shell C while the latter is forcibly advanced by the continuous rotation of the roll 41, so that the merged shells C, D are immediately torn apart at the thin connection therebetween. The separated restraining shell D again grows shortly thereafter and rejoins with the casting shell C to repeat the same tearing process. As a result, a cut is formed on each side surface of the casting B (FIGS. 9 and 12) every time the shells C, D are torn apart, the cut being the cause of subsequent break out.

The above adverse conditions (for deformation and for tear mark formation) will usually continue as long as the rolls 41 are rotated at a constant speed for constant speed withdrawal of the casting.

SUMMARY OF THE INVENTION

It is, therefore, an object of the present invention to provide a method and device for controlling a continuous casting apparatus of the twin mold roll type which have eliminated the problems identified above.

According to a first aspect of the present invention, there is provided a method of controlling an apparatus for continuously casting a thin metallic strip comprising a melt receiver for receiving molten metal, a pair of parallel rolls rotatably arranged under the melt receiver and opposed to each other with a predetermined clearance, rotary drive means for rotating the rolls to draw out the molten metal under solidification as a casting through said clearance, and means for supplying cooling water into the interior of the rolls; the method comprising detecting the surface temperature of each roll by each of a plurality of roll temperature sensors to provide an actual temperature pattern in terms of the rotational position of the roll, the temperature sensors being embedded in the outer peripheral portion of the roll and equiangularly spaced circumferentially thereof, comparing the detected temperature pattern with a preset reference temperature pattern, and controlling the rotary drive means and the cooling water supplying means in accordance with the comparison.

According to this method, the abnormality of the casting shell formed on each roll is recognized by detecting a deviation of the actual roll surface temperature pattern from the reference temperature pattern representative of normal condition. The detection is utilized to suitably control the rotational speed of the roll and the coolant supply to the roll to remove the abnormality, so that it becomes possible to prevent the casting from thickness variation and break out for maintaining good product quality.

According to a second aspect of the present invention, there is provided a device for controlling a continuous casting apparatus comprising a melt receiver for receiving molten metal, a pair of rolls rotatably arranged under the melt receiver and opposed to each other with a predetermined clearance, rotary drive means for rotating the rolls to draw out the molten metal under solidification as a casting through said clearance, and means for supplying cooling water into the interior of the rolls; the controlling device comprising roll temperature sensors embedded in the outer peripheral portion of each roll and equiangularly spaced circumferentially thereof for detecting the surface temperature of the roll, means for detecting the rotational position of the roll, and a control unit for controllling the rotary drive means and the cooling water supplying means in response to detection signals from the temperature sensors and the rotational position detecting means.

Various features and advantages of the present invention will be apparent from the description of an embodiment given with reference to the accompanying drawings.

DETAILED DESCRIPTION

Figure 1:
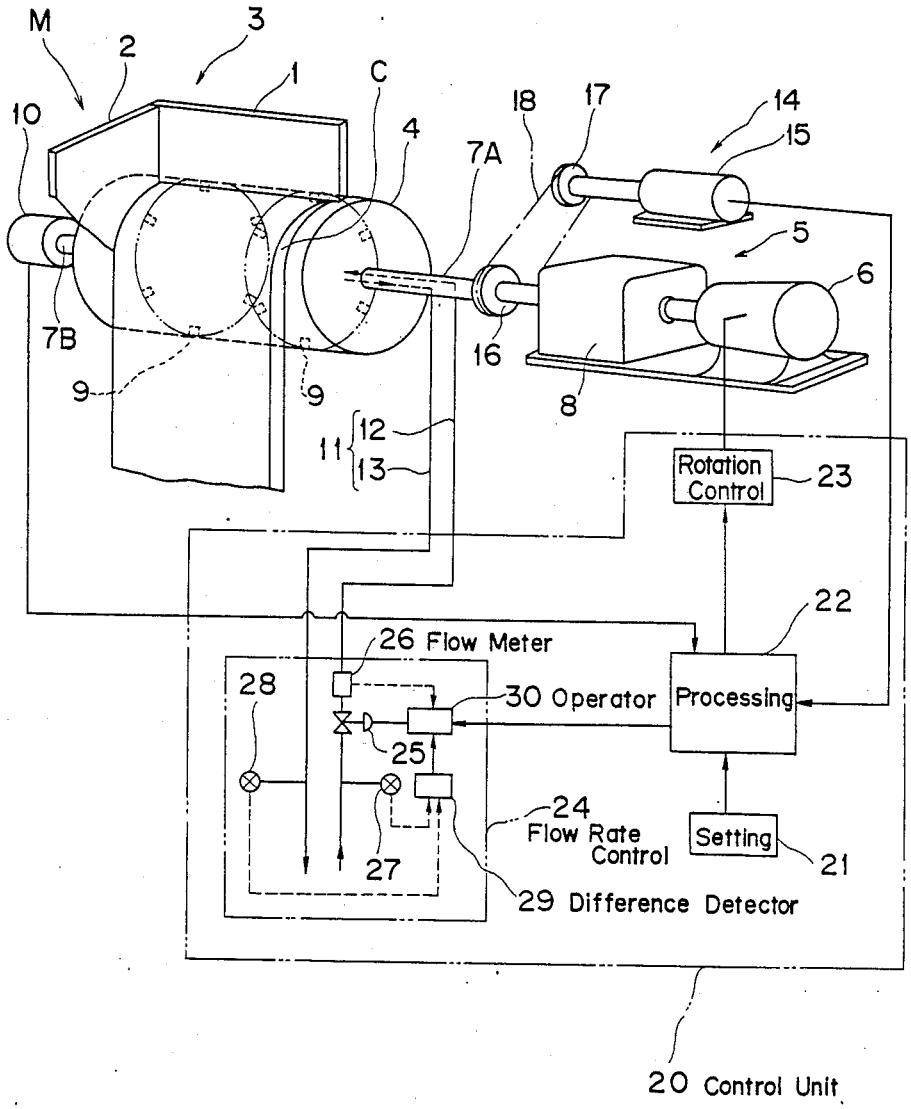
FIG. 1 is a schematic view of a continuous casting apparatus embodying the invention with some parts taken away for simplification.
Figure 9:
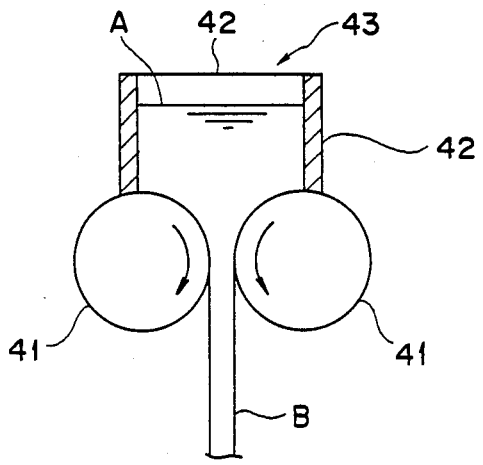
FIG. 9 is a view, partly in section, of a typical twin roll type mold.
Figure 12:
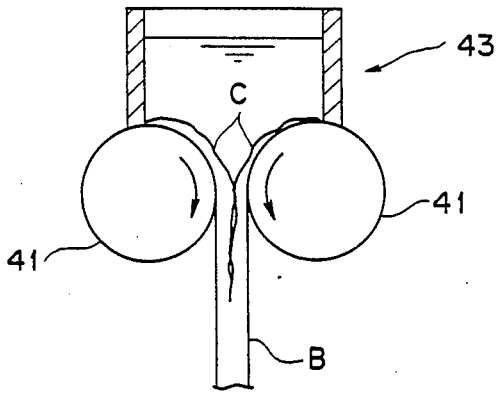
FIG. 12 is a view similar to FIG. 9 but showing the mold under abnormal shell formation.
Figure 10:
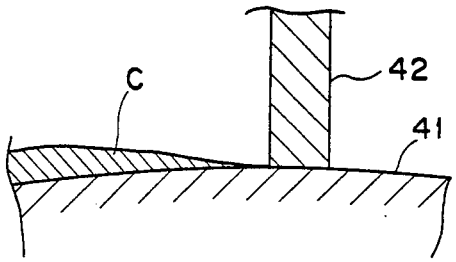
FIG. 10 is an enlarged fragmentary sectional view illustrating a casting shell in normal condition.
Figure 11:
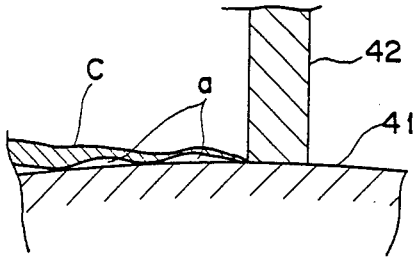
FIG. 11 is a view similar to FIG. 10 but showing the casting shell in deformed condition.
Figure 13:
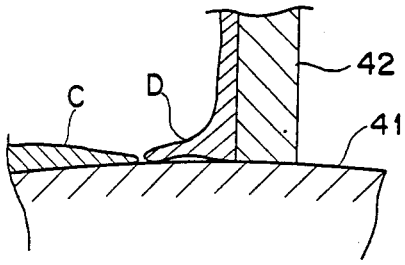
FIG. 13 is a view similar to FIG. 10 but illustrating the casting shell under the influence of a restraining shell.

Referring now to FIG. 1, reference character M represents a twin roll type mold comprising a melt receiver 3 for receiving molten metal, a pair (only one shown) of parallel rolls 4 arranged below the receiver 3 in contact therewith and opposed to each other with a predetermined clearance (refer in this connection to the arrangement shown in FIG. 9 or 12). The receiver 3 includes a pair (only one shown) of first lateral walls 1 parallel to each other and each extending axially of a corresponding roll 4 and a pair (only one shown) of second lateral walls 2 parallel to each other and perpendicular to the first walls 1 to define the width of a casting being produced.

Each roll 4 is rotatably supported and adapted to be rotated in a specified rotational direction by a rotary drive device 5. The drive device 5 comprises an electric motor 6 and a reduction gear 8 coupled to the motor 6 and having a hollow output shaft 7A connected to one end of the roll 4.

Figure 2:
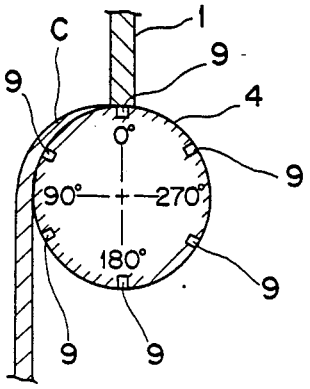
FIG. 2 is a fragmentary sectional view showing each roll of the casting apparatus.

Two axially spaced rows of thermocouples (temperature sensors) 9 are embedded in the outer peripheral portion of the roll 4, and the thermocouples 9 in each row are equiangularly spaced circumferentially of the roll 4 as better illustrated in FIG. 2. The number (six in the illustrated example) of the thermocouples 9 in each row is optional provided that the angular interval between two adjacent thermocouples 9 is less than 90°. The voltage generated by each thermocouple 9 is taken out as output through a slip ring 10 provided on a rotary shaft 7B projecting from the other end of the roll 4. It should be noted that all thermocouples 9 are readily removable for replacement.

The interior of the roll 4 communicates with a coolant circulation system 11 via the hollow shaft 7A. The circulation system 11 includes a supply line 12 connected to an unillustrated pump for feeding cooling water into the roll interior, and a return line 13 for discharging or feeding back the water having received heat from the roll 4.

The rotary shaft 7A is connected to a rotational angular position detecting device 14 which comprises a angle detector such as a rotary encoder 15, a first sprocket 16 fixed on the shaft 7A, a second sprocket 17 mounted on the input shaft of the rotary encoder 15, and a chain 18 engaging both sprockets 16, 17. The rotary encoder 15 produces output representative of the rotational position of the roll 4, i.e., of each thermocouple 9.

The surface temperature of the roll 4 detected by each thermocouple 9 is used to control the rotational speed of the roll 4 and the coolant supply to the roll interior. A control unit for this purpose is generally represented by reference numeral 20 and mainly includes a pattern setting section 21, a processing section 22, a rotation control section 23, and a flow rate control section 24. The processing section 22 receives a temperature signal from each thermocouple 9 through the slip ring 10 as well as a rotational position signal from the rotary encoder 15 to produce an actual temperature pattern in terms of the rotational position of the roll 4. The processing section 22 further compares the obtained actual temperature pattern with a reference temperature pattern preset by the pattern setting section 21 to calculate a difference therebetween. The rotation control section 23, upon receipt of an instruction signal resulted by the calculation of the processing section 22, functions to suitably control the roll drive motor 6. The flow rate control section 24 comprises a flow regulating valve 25 and flow meter 26 disposed in the supply line 12, thermometers 27, 28 provided respectively in the supply and return lines 12, 13, a temperature difference detector 29 for detecting the difference in reading between the two thermometers 27, 28, and an operator 30 for controlling the water supply to the roll 4 by properly operating the valve 24 on the basis of an instruction signal from the processing section 22, a feedback signal from the flow meter 26, and an output signal from the difference detector 29.

The control according to the present invention is based on the following principle. When gaps (not shown) are formed between the roll 4 and a casting shell C thereon or a restraining shell (not shown) grows excessively on the corresponding first lateral wall 1 to ride on the roll 4, the heat transmission to the roll 4 is influenced by the gaps and the grown restraining shell. Thus, it is possible to recognize the shell condition by comparing the actual surface temperature pattern (detected temperature pattern) of the roll 4 with a previously determined temperature pattern (reference temperature pattern) representative of normal condition. Such a recognition is utilized for example to temporarily stop the roll 4 or to adjust the coolant supply to the roll 4, so that the shell condition is corrected immediately.

Figure 3:
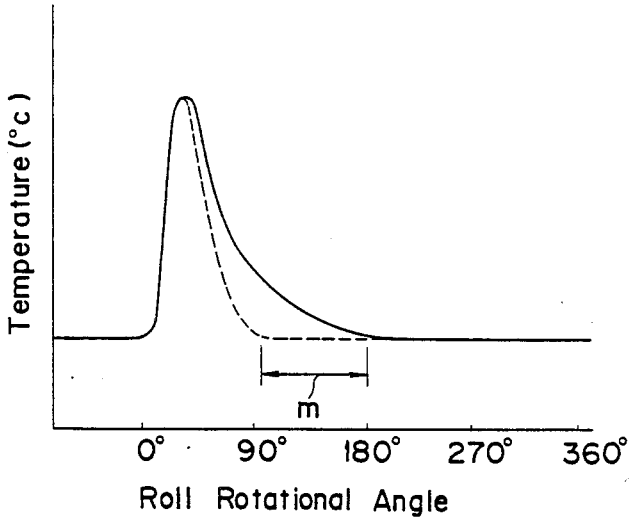
FIGS. 3 and 4 are graphs each illustrating comparison between an actual temperature pattern and a reference temperature pattern.

More specifically, the control device illustrated in FIG. 1 operates in the following manner. When a gap or gaps form between the roll 4 and the casting shell C, a particular thermocouple 9 provides a detected temperature pattern (indicated by the solid line in FIG. 3) which has deviated in temperature drop position from the reference temperature pattern (indicated by the broken line in FIG. 3) by an amount m. The processing section 22 processes this deviation and feeds according instruction signals to the rotation control section 23 and the flow rate control section 24 to reduce the rotational speed of and the water supply to the roll 4 for example. As a result, the roll 4 receives decreased heat from the melt receiver side so that the casting shell C subsequently formed becomes thinner for improved contact with the roll surface to prevent the shell deformation and the resultant unevenness in thickness of the produced casting.

Preferably, the slowing down of the roll rotation is conducted gradually to prevent possible adverse influences on the casting quality due to an abrupt change in the rotational speed. Further, since an excessive decrease in the coolant supply can lead to damage of the roll 4, the temperature difference detector 29 is advantageously designed to feed a control signal to the operator 30 so that the temperature difference between both lines 12, 13 does not exceeds a specified upper limit.

Figure 4:
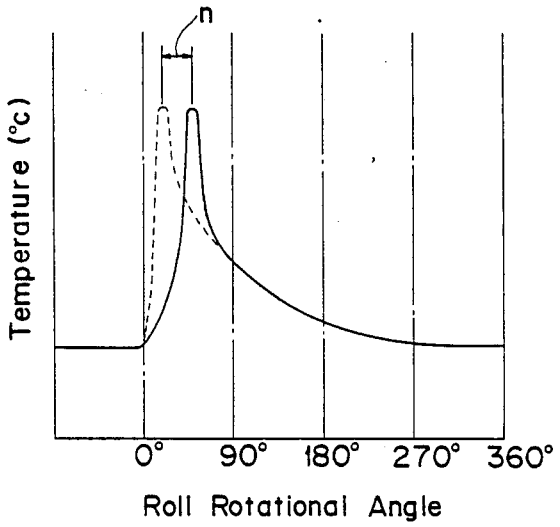
Figure 5:
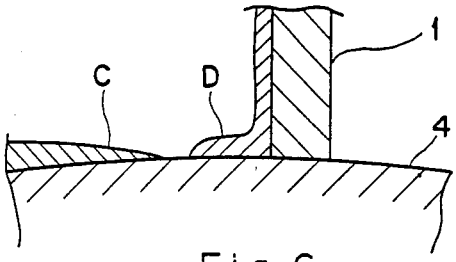
FIGS. 5 to 8 are enlarged fragmentary sectional views illustrating shell formation in the casting apparatus.
Figure 6:
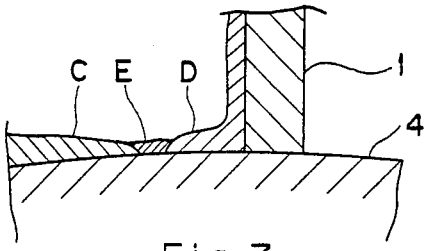
Figure 7:
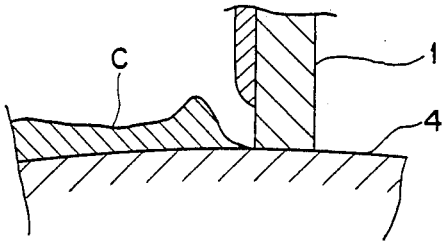
Figure 8:
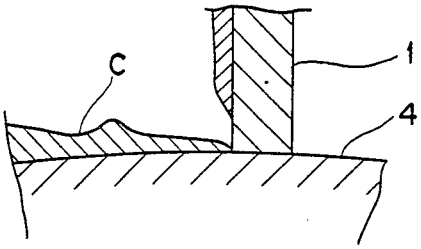

If, on the other hand, a restraining shell D grows unduly as shown in FIG. 5, a different detection temperature pattern (indicated by the solid line in FIG. 4) is obtained which has shifted in temperature peak position from the reference temperature pattern (indicated by the broken line in FIG. 4) by an amount n. In this case, the control unit 20 functions to temporarily stop the roll 4 and thereafter rotate it again. While the roll 4 is temporarily stopped, a connecting shell E is formed between the casting shell C and the restraining shell D and allowed to grow to a sufficient thickness as shown in FIG. 6. Upon subsequent rotation of the roll 4, the restraining shell D is pulled by the moving casting shell C via the connecting shell E to ultimately separate from the lateral wall 1 (FIG. 7). As a result, the casting shell C can again be continuously formed under normal state (FIG. 8) without formation of cuts (break out) at least until a new restraining shell grows to an unacceptable level.

The angular spacing between two adjacent thermocouples 9 in each row is less than 90° as described before. This ensures that at least one thermocouple of each row is always positioned within the 0°~90° range to monitor the shell condition as minutely as possible.

The following enumerates the check items detected for comparison with the reference temperature pattern according to the present invention.

(1) Peak temperature
(2) Time required to reach peak temperature
(3) Temperature drop speed
(4) Temperature at 90° position Of the above, the check items (1) and (2) are used for the detection of a restraining shell, whereas the items (3) and (4) are utilized for the detection of thickness irregularity.

We claim:

1. A method of controlling an apparatus for continuously casting a thin metallic strip comprising a melt receiver for receiving molten metal, a pair of parallel rolls rotatably arranged under the melt receiver and opposed to each other with a predetermined clearance, rotary drive means for rotating the rolls to draw out the molten metal under solidification as a casting through said clearance, and means for supplying cooling water into the interior of the rolls; said method comprising detecting the surface temperature of each roll by each of a plurality of roll temperature sensors to provide an actual temperature pattern in terms of the rotational position of the roll, the temperature sensors being embedded in the outer peripheral portion of the roll and equiangularly spaced circumferentially thereof, comparing the detected temperature pattern with a preset reference temperature pattern, and controlling the rotary drive means and the cooling water supplying means in accordance with the comparison.

2. In an apparatus for continuously casting a thin metallic strip comprising a melt receiver for receiving molten metal, a pair of rolls rotatably arranged under the melt receiver and opposed to each other with a predetermined clearance, rotary drive means for rotating the rolls to draw out the molten metal under solidification as a casting through said clearance, and means for supplying cooling water into the interior of the rolls; a device for controlling the casting apparatus comprising roll temperature sensors embedded in the outer peripheral portion of each roll and equiangularly spaced circumferentially thereof for detecting the surface temperature of the roll, means for detecting the rotational position of the roll, and a control unit for controlling the rotary drive means and the cooling water supplying means in response to detection signals from the temperature sensors and the rotational position detecting means.

3. A device as defined in claim 2, wherein the control unit comprises a pattern setting section for presetting a reference temperature pattern, a processing section for producing an actual temperature pattern on the basis of detection signals from each temperature sensor and the rotational position detecting means and for comparing the actual temperature pattern with the reference temperature pattern, a rotation control section for controlling the rotary drive means in response to an output from the processing section, and a flow rate control section for controlling the cooling water supplying means in response to another output from the processing section.

4. A device as defined in claim 3, wherein the cooling water supplying means comprises a supply line through which the cooling water is fed into the roll interior and a return line through which the cooling water is sent back from the roll interior, and the flow rate control section comprises a flow rate regulating valve provided in the supply line, a flow rate meter provided in the supply line, water temperature sensors arranged in the supply and return lines respectively, a temperature difference detector for detecting the temperature difference between the water temperature sensors, and operating means for operating the flow rate regulating valve in accordance with the outputs of the processing section and the temperature difference detector as well as a feedback signal from the flow rate meter.

5. A device as defined in claim 2, wherein the roll temperature sensors are arranged in a plurality of rows spaced axially of the roll.

6. A device as defined in claim 5, wherein the angular spacing between two adjacent roll temperature sensors in each row is less than 90°.

* * * * *